US005451486A

United States Patent [19]

Pilot et al.

[11] Patent Number: 5,451,486

[45] Date of Patent: Sep. 19, 1995

[54] PHOTOGRAPHIC CONTRAST PROMOTING AGENTS

[75] Inventors: John F. Pilot, Carteret; Syeda Husain, Middletown; Penny M. Mullen, Howell; Burton H. Waxman, Rockaway, all of N.J.

[73] Assignee: Sun Chemical Corporation, Fort Lee, N.J.

[21] Appl. No.: 343,820

[22] Filed: Nov. 22, 1994

[51] Int. Cl.[6] ..... G03C 1/06

[52] U.S. Cl. ..... 430/264; 430/598; 430/435

[58] Field of Search ..... 430/264, 598, 435

[56] References Cited

U.S. PATENT DOCUMENTS 4,975,354 12/1990 Machonkin et al. ..... 430/264
4,994,365 2/1991 Looker et al. ..... 430/264
5,279,919 6/1994 Okamura et al. ..... 430/264
5,316,890 5/1994 Okamura et al. ..... 430/264
5,378,578 1/1995 Hoshimiya et al. ..... 430/264

FOREIGN PATENT DOCUMENTS 0598315 5/1994 European Pat. Off. .
5204075 3/1992 Japan .

*Primary Examiner*—Thomas R. Neville
*Attorney, Agent, or Firm*—Jack Matalon

[57] ABSTRACT

Photographic film nucleating agents comprising aryl sulfonamidophenyl hydrazides containing alkene, alkadienyl, alkapolyenyl or cycloalkenyl substituted pyridinium functionality; these nucleators produce better dot quality and superior contrast characteristics in image-wise exposed film elements and wider compatibility with standard rapid access developers and obviate the need to include boosters in the film or in the developer.

17 Claims, No Drawings

PHOTOGRAPHIC CONTRAST PROMOTING AGENTS

FIELD OF THE INVENTION

This invention relates to photographic films and to compounds employed in photographic films to promote high contrast development of imagewise exposed films. The invention particularly relates to lithographic films containing aryl sulfonamido hydrazides that serve as contrast enhancing nucleating agents, especially those hydrazides incorporating aromatic nitrogen heterocyclic moieties that also contain alkenyl, alkadienyl, alkapolyenyl or cycloalkenyl substituents.

BACKGROUND OF THE INVENTION

The utilization of silver halide technology in the Graphic Arts Industry has been primarily focused on the creation of high contrast systems, which are necessary to obtain strong discrimination of image and good image quality/dot characteristics. To this end, the earliest high contrast system, which is called the "lith" system, utilized a low sulfite, hydroquinone based developer with silver chlorobromide emulsions, further modified by polyethyleneoxide compounds.

The "lith" system provided high contrast, excellent image discrimination and good "dot" characteristics. The single greatest drawback of the system was the instability of the developer system which required a multi-part, compound developer and a low temperature (75°-80° F.) processing solution in order to maintain controlled developing solutions. These conditions further necessitated long processing times, sometimes as much as 2½ minutes for development, but more commonly 1½ minutes. The process was further complicated by the fact that "non-lith" films were frequently also processed in the same developers due to convenient configurations at various customers.

In order to increase development rates and lower processing times, the Graphic Arts Industry gravitated to the use of auxiliary developing agents in addition to hydroquinone. These agents include metol, phenidone, and the like. Simultaneously, to increase developer life, the developing solutions employed higher concentrations of sulfite to extend the lifetimes of the solutions, increase their resistance to aerial oxidation, afford greater uniformity of developer condition, and increase in development rate by allowing an increase in the temperature of the processing solution. These new "rapid access" developers were simpler to maintain and required about 30 seconds of development time, affording faster throughput, ease of operation, and greater compatibility with non-lith type films. The single greatest drawback of these systems was the lack of the excellent image discrimination and dot characteristics that had been achieved with the lith system.

In U.S. Pat. No. 3,730,727, the use of formyl phenylhydrazines incorporated in the developer is discussed to improve image discrimination without the use of the low-sulfite lith techniques. It was shortly brought to practice in the "lith" system described in U.S. Pat. No. 4,224,401, which describes a lith-type result with a high pH, high sulfite-type developer solution. In U.S. Pat. No. 4,269,929, the system is further refined by employing alkanol amines to lower the operable pH of the developer to practical levels, thus permitting commercialization of the type of developer known as "hybrid" developer. Hybrid developers provide the results of lith developers but at rapid access developing speeds.

Subsequent to the foregoing disclosures, U.S. Pat. Nos. 4,686,167, 4,798,780, 4,937,160, and 4,882,261, all disclosed novel hydrazine "nucleators" which afforded the hybrid effect.

While hybrid systems have been commercialized, the flaw of the hybrid system resides in the alkanol amines incorporated within the developer solution to boost or promote high contrast. These amines, which still required a pH of 11.0 or greater, had the adverse effects of attacking the processor equipment and were basically incompatible with a great variety of non-hybrid lithographic films that were frequently processed in the same chemistries.

An approach to overcome the flaws of developer solutions containing alkanol amine was disclosed in U.S. Pat. Nos. 4,975,354 and 4,994,365. These patents taught a new hybrid system which removed the alkanol amines from the developer and positioned them in the film. These amines, ostensibly called boosters, were to activate the film incorporating the hydrazine nucleators, thus making them compatible with standard, low cost developing solutions.

The drawback of the systems which incorporated the alkanol amine boosters into the film containing the nucleators was the complexity of balancing the nucleator with the boosters to provide good discrimination at low fog or pepper levels while broadening the degree of compatibility with a number of existing rapid access developer systems. U.S. Pat. No. 5,264,323 describes the complications of balancing the hybrid systems which involves both nucleator plus booster.

Addressing this concern, U.S. Pat. No. 4,994,365 describes the use of alkyl-ballasted quaternary pyridine nucleators, compatible with the boosters, which afforded good discrimination and good dot quality. The drawback of this system is the interaction of the nucleator and booster. That interaction limits the systems compatibility with many existing rapid access systems.

U.S. Pat. No. 4,975,354 first described the use of "booster" technology, and U.S. Pat. No. 4,994,365 describes the use of alkyl ballasted pyridine nucleators as a method to improve image quality with the incorporated boosters. These patents are best represented by the following analog examples of Nucleators I and II and Booster I:

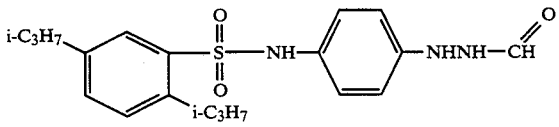

Nucleator I

-continued

Nucleator II

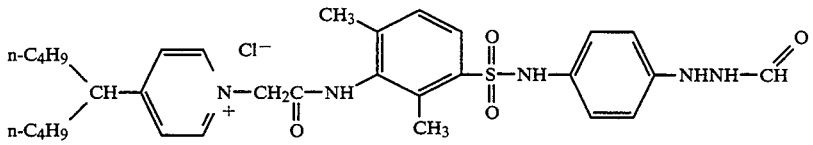

Booster I

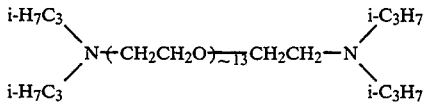

It is an object of the present invention to provide nucleator compounds having contrast enhancing properties superior to those in the prior art in conjunction with high dot quality and speed so that photographic film can be produced without a need for incorporating nucleation boosters in the formulation.

It is another object of the invention to produce superior nucleator compounds that incorporate olefinic unsaturation in the formulae or structures of the compounds.

Yet another object of the invention is to provide photographic film elements, and a process for their production, that produce a high contrast image without nucleator boosters by incorporating nucleators in the film comprising aryl sulfonamidophenyl hydrazides containing alkene substituted pyridinium functionality.

A further object of the invention is to provide a process for forming a high contrast image by employing novel nucleators comprising alkene substituted pyridinium aryl sulfonamidophenyl hydrazides.

SUMMARY OF THE INVENTION

A series of photographic contrast enhancing agents or nucleators has been discovered that produces better dot contrast characteristics in imagewise exposed film elements and wider compatibility with standard rapid access developers. Most notably, the nucleators of the invention provide the improved contrast enhancing properties without requiring the use of boosters in the film or alkanol amines in the developer. The novel nucleators comprise aryl sulfonamidophenyl hydrazides containing alkene, alkadienyl, alkapolyenyl or cycloalkenyl substituted pyridinium functionality.

More particularly, the invention comprises photographic film nucleating agents having the structure

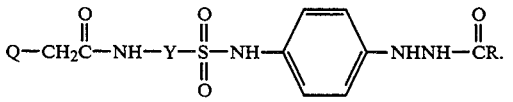

III wherein R is hydrogen or $C_1$–$C_{10}$ alkyl, substituted or unsubstituted carbamoyl, aryloxy or alkoxy carbonyl; Y is aryl, substituted or unsubstituted, and Q is selected from the group consisting of pyridinium compounds having the structure

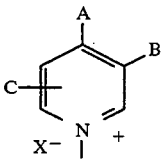

wherein A, B or C are hydrogen, aryl, alkyl, alkenyl, alkadienyl, alkapolyenyl, cycloalkenyl or unsaturated nitrogen heterocycle radicals with at least one of A, B or C comprising $C_2$–$C_{18}$ alkenyl, alkadienyl, alkapolyenyl or cycloalkenyl or said unsaturated nitrogen heterocycle radicals; and X is halide. The most preferred $C_2$–$C_{18}$ alkadienyl for A, B or C is 2,7-nonadien-5-yl.

The substituted or unsubstituted carbamoyl of the agent of the invention has the following structure wherein $R_4$ and $R_5$, alike or different, are selected from the group consisting of hydrogen, alkyl, alkenyl, aryl, pyrrolidyl and piperidyl,

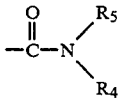

A preferred piperidyl radical comprises 2,2,6,6-tetramethyl-4-piperidyl having the structure

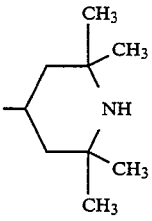

Preferred nucleators of the invention include compounds 1, 2 and 3 having the following structures:

Compound 1

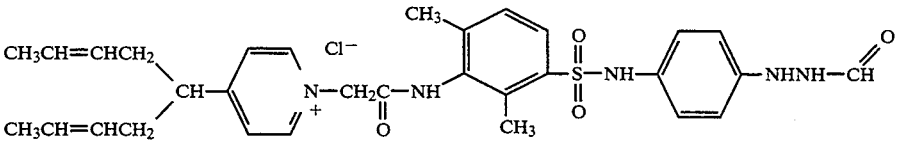

-continued

Compound 2

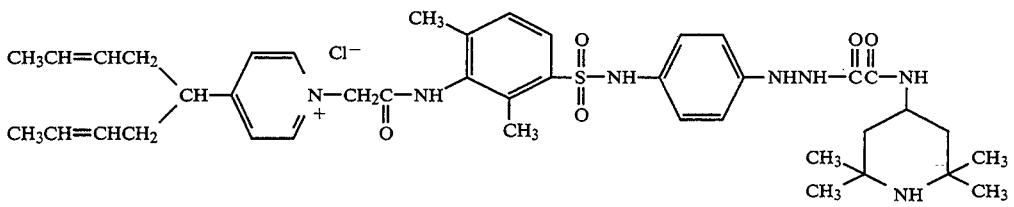

Compound 3

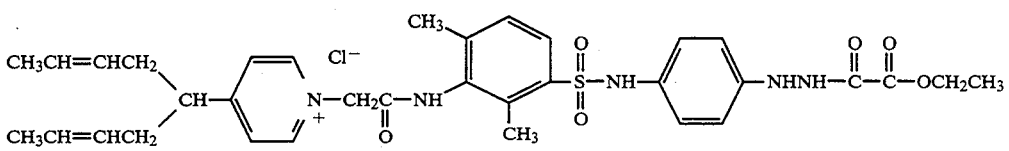

DETAILED DESCRIPTION OF THE INVENTION

A new class of nucleators for graphic arts films has been found that is distinguished over others reported in the prior art by the presence of pyridinium moieties containing unsaturated hydrocarbon substituents. The general structure for these materials is depicted below (III). These nucleators increase the speed and contrast of lithographic films and also improve the dot quality for halftone applications. Some of the advantages they impart to lithographic films are summarized by the following list:

- high contrast, which provides excellent sharpness to the edge of the image;
- excellent dot quality, equal or better to the current state of the art;
- high photographic speed, which is suitable for halftone films;
- as an added benefit, the use of these nucleators does not require "boosters" to provide good dot quality and speed.

The novel nucleators of the present invention fall within those pyridinium salt derivatives of aryl sulfonamidophenyl hydrazides having the general structure

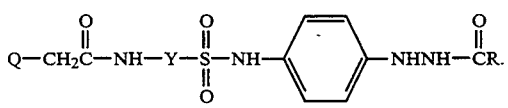

III wherein R is hydrogen or $C_1$–$C_{10}$ alkyl, substituted or unsubstituted carbamoyl, aryloxy or alkoxy carbonyl, Y is aryl, substituted or unsubstituted, and Q is selected from the group consisting of pyridinium compounds having the structure

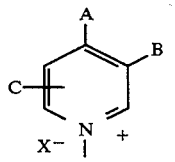

wherein A, B or C are hydrogen, aryl, alkyl, alkenyl, alkadienyl, alkapolyenyl, cycloalkenyl or unsaturated nitrogen heterocycle radicals with at least one of A, B or C comprising $C_2$–$C_{18}$ alkenyl, alkadienyl, alkapolyenyl or cycloalkenyl or unsaturated nitrogen heterocycle radicals; and X is halide.

Preferred alkenyl or alkadienyl substituents on the pyridinium moiety include vinyl, 1-propenyl, allyl, isopropenyl, 2-butenyl, isobutenyl, 3-pentenyl, hexenyl, octenyl, divinylmethyl, diallylmethyl, 1,5-hexadien-3-yl, 2,5-heptadien-4-yl, 2,6-octadien-4-yl and 2,7-nonadien-5-yl. The most preferred $C_2$–$C_{18}$ alkadienyl is 2,7-nonadien-5-yl. Useful unsaturated nitrogen heterocycle radical substituents on the pyridinium moiety include pyrrolyl, N-alkadiylpyrrrole and pyridyl.

The nucleators of the invention are utilized by incorporation into a photographic element which comprises, among other materials, a light sensitive silver halide coating or layer on a substrate. The production of photographic elements is well known in the art as described in U.S. Pat. No. 4,988,604. Generally, the nucleators are applied to the substrate by incorporating them in the silver halide emulsion prior to coating of the substrate. However, the nucleators may be applied directly to the substrate or included with another coating material as it is applied to the substrate. After drying of the coated element, the element is ready for imagewise exposure.

The hydrazide nucleator of the invention is typically employed at a concentration of from about $1\times10^{-4}$ to about $5\times10^{-3}$ moles per mole of silver, more preferably in an amount of from about $2.5\times10^{-4}$ to about $2.5\times10^{-3}$ moles per mole of silver, and most preferably in an amount of from about $5\times10^{-4}$ to about $1.5\times10^{-3}$ moles per mole of silver.

The hydrazides are employed in this invention in combination with negative-working photographic emulsions comprised of radiation-sensitive silver halide grains capable of forming a surface latent image and a binder. The silver halide emulsions include high chloride emulsions conventionally employed in forming lithographic photographic elements, as well as silver bromide and silver bromoiodide emulsions which are recognized in the art as being capable of attaining higher photographic speed.

Silver halide emulsions contain a binder in addition to silver halide grains. The proportion of binder can be widely varied, but typically is within the range of from about 20 to 250 grams per mole of silver halide.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls and merostyryls.

By a suitable choice of substituent groups, the dyes can be cationic, anionic or nonionic.

The layers of the photographic elements can be coated on a variety of supports. Typical photographic supports include polymeric film, paper, metallic sheet or foil, glass and ceramic elements. Typical of useful polymeric film supports are films of cellulose nitrate and cellulose esters such as cellulose triacetate and diacetate, polystyrene, polyamines, homo- and co-polymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

The photographic elements can be imagewise exposed with various forms of energy, which encompass the ultraviolet and visible (e.g.,actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James in The Theory of the Photographic Process, 4th Ed., MacMillan, 1977, Chapters 4, 6, 17, 18 and 23.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images.

It is preferred that the novel photographic elements of this invention are processed in developing compositions containing a dihydroxybenzene developing agent. It is more preferred that they are processed in a developing composition containing an auxiliary developing agent in addition to the dihydroxybenzene which functions as the primary developing agent. It is especially preferred that the auxiliary developing agent be phenidone-types (1-phenyl-3-pyrazolidinone).

The following examples are presented to illustrate the preparation of the novel nucleators of the invention and to compare their performance with nucleators and boosters of the prior art. The novel nucleators whose preparation and performance are described hereinafter are representative examples of the nucleators of the invention generically described as structural formula (III) herein before.

EXAMPLE 1

Preparation of Intermediate A

Intermediate A was prepared according to the methods described in U.S. Pat. Nos. 4,030,925 and 4,994,365. The structure of intermediate A is as follows:

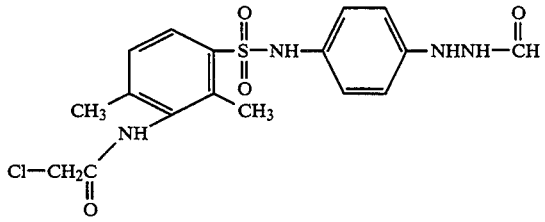

EXAMPLE 2

Preparation of Intermediate B

Intermediate B was prepared according to the methods described in U.S. Pat. Nos. 5,158,856, 5,229,248, 5,279,920 and 4,994,365. The structure of Intermediate B is as follows:

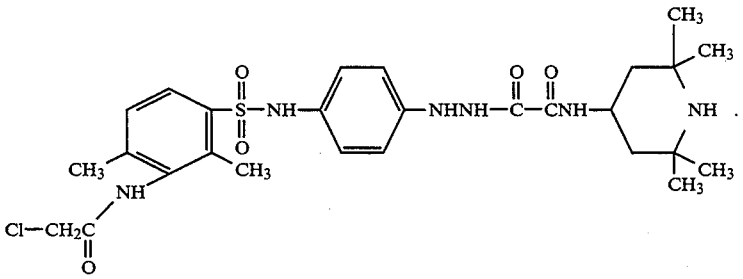

EXAMPLE 3

Preparation of Intermediate C

Intermediate C was synthesized according to U.S. Pat. Nos. 4,686,167 and 4,994,365 and has the following structure:

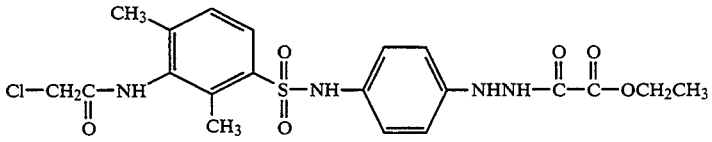

EXAMPLE 4

Preparation of Comparative Nucleator and Booster Compounds

A series of comparative nucleator compounds and boosters were prepared by methods known in the art to compare with nucleator compounds of the present invention. Nucleator I, Comparative Compound 1a, i.e., Nucleator II, and Booster I and II were prepared as described in U.S. Pat. Nos. 5,104,769, 4,994,365, and 4,975,354. Comparative Compound 2a was prepared by a method similar to that used to prepare Comparative Compound 1a, but starting from Intermediate B (M.P. greater than 265° C.). Compound 3a was prepared as described in U.S. Pat. No. 4,994,365.

The structures of these known compounds are as follows:

Nucleator I

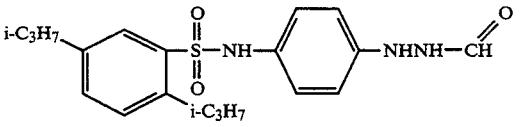

Comparative Compound 1a

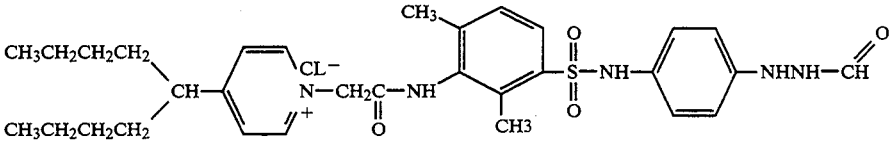

Comparative Compound 2a

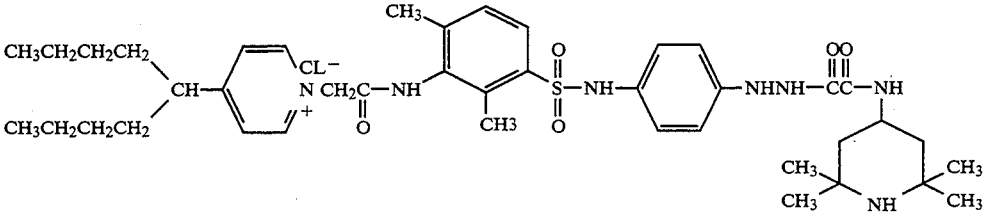

Comparative Compound 3a

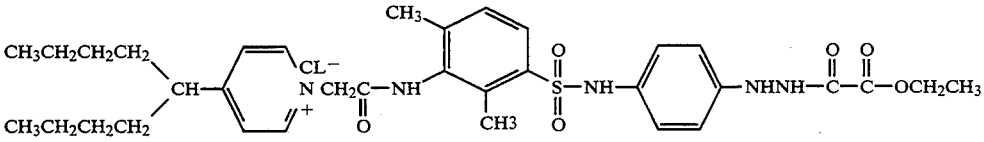

Booster I

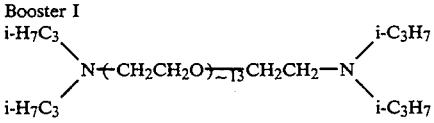

Booster II

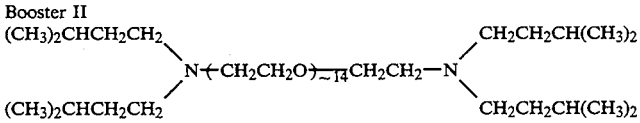

EXAMPLE 5

A more detailed description illustrating the general method of synthesis is provided as follows for Compound 1 of the invention.

Compound 1

A mixture of 205.5 grams (0.5 mole) of Intermediate A and 258 grams (1.282 mole) of 5-(4-pyridyl)-2,7-nonadiene in 410 milliliters of N,N-dimethylacetamide was heated on a steam bath for one and one-half hours. After cooling to room temperature, the reaction mixture was diluted with 580 milliliters of methanol and added dropwise into 10 liters of isopropyl ether. After stirring for a few minutes, the isopropyl ether was decanted. The gummy solid was dissolved in 550 milliliters of methanol and then poured dropwise into 9 liters of isopropyl ether with stirring. The isopropyl ether was decanted and the solid stirred again with 4.5 liters of fresh isopropyl ether. The solid was filtered and air-dried: Yield=330 grams of a hygroscopic solid. This solid was again dissolved in 580 milliliters of methanol and then added with stirring into 8 liters of isopropyl ether. After decanting the isopropyl ether, the solid was stirred with 4 liters of fresh isopropyl ether, filtered and dried: Yield=310.6 grams. This 310.6 grams of solid was again dissolved in 680 milliliters of methanol and poured into 14 liters of isopropyl ether. The solid was then again stirred with 3.8 liters of isopropyl ether, filtered, washed with a little isopropyl ether, and finally dried for two days in a vacuum chamber at 0.01 mm surrounded by refluxing xylene. Overall yield: 270 grams (88%): MP 270 degrees C., with bubbling at 260 degrees C.; Elemental Analysis: Theory for $C_{31}H_{38}ClN_5O_4S$: C=60.82, H=6.26, Cl=5.79, N=11.44 and S=5.24; Found: C=60.50, H=6.38, Cl=5.98, N=11.20 and S=5.26.

Compound 1 of the invention has the structure:

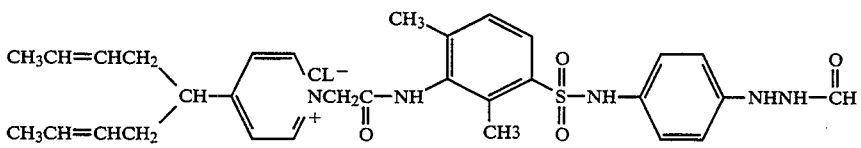

Compound 1

Compound 2 of the invention, having the following structure, was prepared in a manner analogous to compound 1 and is described in Example 6.

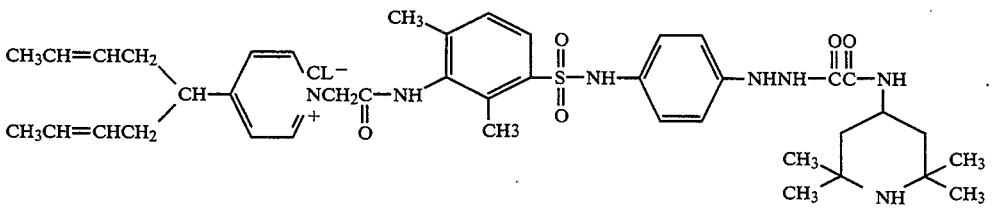

Compound 2

EXAMPLE 6

Compound 2

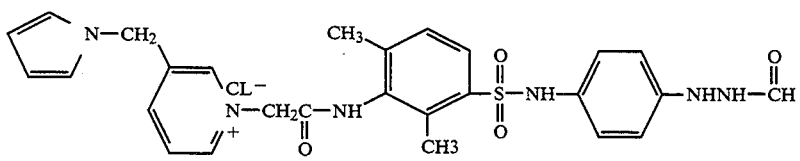

Compound 4

2.05 grams (0.00346 mole) of intermediate B and 1.78 grams (0.00884 mole) of 5-(4-pyridyl)-2,7-nonadiene in 6 mls of N,N-dimethylacetamide was heated on a stream bath for 1.5 hours. After cooling to room temperature, the reaction mixture was diluted with 10 mls of methanol and poured into isopropyl ether. Isopropyl ether was decanted and the solid was again stirred with fresh isopropyl ether. The solid was filtered and purified from methanol/isopropyl ether. The yield was 2.38 g (87%); M.P. softening at 245° C.>255° C.

Compound 3 of the invention, having the following structure, was prepared in a manner analogous to compound 1 and is described in Example 7.

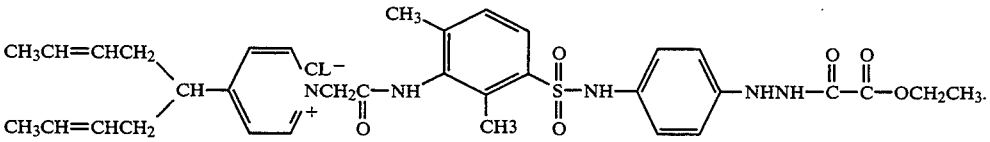

Compound 3

EXAMPLE 7

Compound 3

A mixture of 2.4 grams (0,005 mole) of Intermediate C and 2.50 grams (0.0124 mole) of 5-(4-pyridyl)-2,7-nonadiene in 6 mls of N-N-dimethylacetamide was heated on a steam bath for one and one-half hours. After cooling to room temperature, the reaction mixture was diluted with 5 mls of methanol and poured dropwise into 200 mls of isopropyl ether. The solid was again stirred with isopropyl ether, purified by dissolving in 20 ml of methanol and poured into 180 ml of isopropyl ether. The yield was 2.68 grams (76%) of a compound having a m.p. of 175° C. (softening), clear at 222° C. and bubbling at 275° C. Analysis for $C_{34}H_{42}O_6N_5SCl.H_2O$ (M.W. 702.26): Calculated: C, 58.15; H, 6.31; N, 9.97; S, 4.57. Found: C, 58.05; H, 6.13; N, 10.36; S, 4.79.

Compound 4 of the invention, having the following structure, was prepared in a manner analogous to compound 1 and is described in Example 8.

EXAMPLE 8

Compound 4

2.10 grams (0.0051 mole) of Intermediate A and 1.79 grams (0.0113 mole) of 3-(pyrrol-yl-methyl)pyridine was taken in 7 mls of N-N-dimethylacetamide and heated on a steam bath for one and one-half hours. After cooling to room temperature, the reaction mixture was diluted with 5 mls of methanol. The product was isolated by pouring into isopropyl ether as in prior Examples 5-7. The yield was 2.64 grams (91%) of a compound having a M.P. (bubbling) at 185° C. and clear at 245° C.>275° C.

Compound 5 of the invention, having the following structure, was prepared in a manner analogous to compound and is described in Example 9.

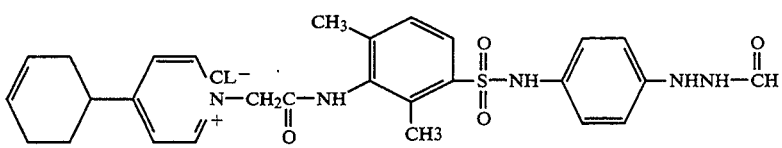

Compound 5

EXAMPLE 9

Compound 5

A mixture of 2.10 grams (0.00511 mole) of Intermediate A and 1.81 grams (0.01137 mole) of 4-(3-cyclohexen-1-yl) pyridine in 7 mls of N-N-dimethylacetamide was heated on a steam bath for one and one-half hours. After cooling to room temperature, the reaction mixture was diluted with 5 mls of methanol and poured dropwise into 280 mls of isopropyl ether. The ether was decanted and the solid was again stirred with isopropyl ether, purified by dissolving in 18 ml of methanol and poured into isopropyl ether. The yield was 2.35 grams (81%) of a compound having a M.P. of 210° C. (softening), bubbling at 235° C. and clear at 275° C. Analysis for $C_{28}H_{32}O_4N_5SCl.1.5H_2O$ (M.W. 566.13): Calculated C, 56.32; H, 5.91; N, 11.73; S, 5.37; Cl, 5.94; Found C, 56.67; H, 5.92; N, 11.49; S, 5.30; Cl, 5.90.

EXAMPLE 10

Photographic Evaluation of Test and Comparative Compounds

An 80:20 chloro-bromide emulsion having cubic crystals of 0.25 micron size was prepared by an ammoniacal method using a balanced double jet precipitation of one mole of 1.2 Normal silver nitrate, and a 1.55 mole mixture of potassium bromide-ammonium chloride with 2.2 grams per mole of ethylenediamine and 335 nanomole per mole of sodium hexachlororhodate, into a 3.6 weight percent gel solution at pH 8 over a 15 minute 30 period at 35 degrees C. The soluble by-product salts were removed by washing after coagulating the emulsion with an aromatic sulfonate at low pH. The emulsion was then redispersed to a 10 percent silver analysis with 55 grams per mole of gelatin, and was digested at 50 degrees C. for 42 minutes at pH 6 in the presence of 0.05 mole iodide, 7 mg sodium benzenethiosulfinate, 11 micromoles sodium tetrachloroaurate, and 31 micromoles sodium thiosulfate. The emulsion was stabilized with 4500 micromoles of 4-Hydroxy-6-Methyl-1,3,3a,7-tetraazaindene, spectrally sensitized with 5-[(3-ethyl-2-thiazolidine)-ethylidene]-4-oxo-2-thioxo-3-thiazolidine acetic acid, sodium dioctylsulfosuccinate was added as a coating aid at 0.7 grams per mole of silver, a latex for dimensional stability, and the Comparative and Test Compounds were added as methanol solutions at the level of $1\times10^{-3}$ mole per mole of silver. The emulsions were then coated onto a polyester base at 40 mg silver per square decimeter, and were overcoated with an aqueous gelatin anti-abrasion layer containing dimethylolurea as a hardening agent. The dried film samples were exposed using a tungsten point source, and were processed in the developer whose composition is listed in Table A below, and fixed with the Fixer solution described in Table B. The sensitometric data are included in Table 1 and 2.

TABLE A

Developer Composition

| Ingredient | Amount (a) |
|---|---|
| EDTA, Tetra-Sodium Salt | 4.00 |
| Sodium Sulfite | 13.33 |
| Potassium Hydroxide, 45% | 51.90 |
| 5-Nitroindazole | 0.049 |
| Hydroquinone | 18.50 |
| Phenidone-B | 0.50 |
| 1-Phenyl-5-mercaptotetrazole | 0.01 |
| Benzotriazole | 0.025 |
| Diethanolamine, 85% | 6.43 |
| Sodium Metabisulfite | 30.00 |
| Potassium Carbonate, anhy. | 20.00 |
| Potassium Bromide | 4.00 |
| Gluteraldehyde Bisulfite, 22% | 22.73 |
| Water | To 1.0 liter |
| pH | To 10.55 |

(a) All ingredients are in terms of grams per liter of working strength solution, and processing conditions were 30 seconds at 38 degrees C.

TABLE B

Fixer Composition

| Ingredient | Amount (a) |
|---|---|
| Ammonium Thiosulfate, 60% | 276.75 |
| Sodium Acetate | 21.20 |
| Sodium Metabisulfite | 9.05 |
| Acetic Acid, Glacial | 8.37 |
| Citric Acid | 3.28 |
| Water | To 1.0 liter |
| pH | To 4.80 |

(a) Same as footnote to Table A.

TABLE 1

Photographic Results (a)

| Test Compounds | Booster | Gradient | Dot Quality |
|---|---|---|---|
| | (Control Compounds) | | |
| None | None | 7.3(Poor) | 1(Poor) |
| Booster I | 1 gm/mole Ag | 7.1 | 1 |
| | (Comparison Compounds) | | |
| Nucleator I | None | 8.0 | 2 |
| Compound 1a | None | 10.6 | 3 |
| Compound 2a | None | 11.6 | 3 |
| Compound 3a | None | 10.7 | 3 |
| | (Invention Compounds) | | |
| Compound 1 | None | 27.3(Exc.) | 4.5(Exc.) |
| Compound 2 | None | 22.4 | 4.5 |
| Compound 3 | None | 19.9 | 4 |
| Compound 4 | None | 17.3 | 3.5 |
| Compound 5 | None | 20.3 | 4 |

(a) The films were exposed by a tungsten bulb through a 2 Log E continuous tone wedge. The Gradient was measured from the densities of 0.5 to 3.0 above base plus fog. The base plus fogs were all 0.04, and the maximum densities were all greater than 5.0. The halftone dot quality is expressed on a scale of 1 to 5, with 5 = excellent, hard "lith" type dots, and 1 = poor, fuzzy, continuous tone type dots.

Gradients of less than 15 result in a loss of image discrimination, and a dot quality of 3.5 or better is necessary for proper performance. Compound 1 of this invention clearly demonstrates an almost 3-fold increase in contrast, and improved dot characteristics as compared to its saturated analog, Compound la. U.S. Pat. No. 5,279,919 describes the use of Compound 1a in a similar non-booster film element, and without alkanol amines in the developer. The results in that patent show poor dot characteristics for compound la and those results are confirmed herein as reported in Tables 1 and 2. The other examples of this invention, unsaturated Compounds 2 and 3, also have higher gradients and better dot qualities than their corresponding saturated analogs, Compounds 2a and 3a.

A direct comparison of Compounds 1 and 1a, at different levels, both with and without booster is shown in Table 2. In this instance, the booster is the i-pentyl analog as shown structurally herein before as Booster II. The samples were made and processed in the same developer as described above. The data in Table 2 clearly show the advantage of the unsaturated functionality for gradients, speed, and dot quality.

TABLE 2

Photographic Results, With and Without Booster[a]

| Test Cpds | Amount[b] | Booster II[c] | Speed | Gradient | Dot Quality |
|---|---|---|---|---|---|
| None | None | None | 0.74 | 8.4 | 1 |
| None | None | 1.5 | 0.71 | 7.8 | 1 |
| Compound 1 | $5 \times 10^{-4}$ | None | 0.64 | 18.0 | 4 |
| Compound 1a | $5 \times 10^{-4}$ | None | 0.71 | 7.0 | 2 |
| Compound 1 | $5 \times 10^{-4}$ | 1.5 | 0.60 | 17.3 | 4 |
| Compound 1a | $5 \times 10^{-4}$ | 1.5 | 0.67 | 6.1 | 2+ |
| Compound 1 | $1 \times 10^{-3}$ | 1.5 | 0.61 | 26.8 | 4+ |
| Compound 1a | $1 \times 10^{-3}$ | 1.5 | 0.66 | 11.9 | 3 |

[a]The films were exposed and processed as described in the footnotes to Table 1 and Table A. Speed is expressed in terms of Relative Log Exposure. Gradient and Dot quality are described in the footnote to Table 1.
[b]Expresses in terms of moles of nucleator per mole of silver.
[c]Expressed in terms of grams per mole of silver.

What is claimed is:

1. A silver halide lithographic film element having high contrast and dot quality developable in rapid access developers without requiring boosters or alkanol amines, said element having coated thereon a silver halide emulsion and containing at least one layer incorporating a hydrazine nucleating agent having the structure

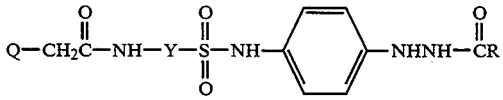

wherein R is hydrogen or $C_1$–$C_{10}$ alkyl, carbamoyl, aryloxy or alkoxy carbonyl; Y is divalent aryl, and Q is selected from the group consisting of pyridinium compounds containing unsaturated substituents, said pyridinium compounds having the structure

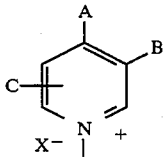

wherein A, B or C are hydrogen, alkadienyl, alkapolyenyl, cycloalkenyl or unsaturated nitrogen heterocycle radicals, with at least one of A, B or C comprising alkadienyl, alkapolyenyl, cycloalkenyl or said unsaturated nitrogen heterocycle radicals; X is an inorganic or organic anion; wherein said element, after image-wise exposure and development, exhibits a gradient of at least 20 and excellent dot quality at a loading of said nucleating agent of $1 \times 10^{-3}$ moles per mole of silver.

2. The element of claim 1 wherein X is halide.

3. The element of claim 1 wherein said carbamoyl has the following structure

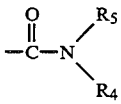

wherein $R_4$ and $R_5$, alike or different, are selected from the group consisting of hydrogen, alkyl, alkenyl, aryl, pyrrolidyl and piperidyl.

4. The element of claim 3 wherein said piperidyl comprises 2,2,6,6-tetramethyl-4-piperidyl.

5. The element of claim 1 wherein said unsaturated substituents are selected from the group consisting of divinylmethyl, diallylmethyl, 1,5-hexadien-3-yl, 2,5-heptadien-4-yl, 2,6-octadien-4-yl, 2,7-nonadien-5-yl and 3-(cyclohexen-1-yl), pyrrolyl, N-alkadiylpyrrole and pyridyl.

6. The element of claim 1 wherein said hydrazine nucleating agent has the structure

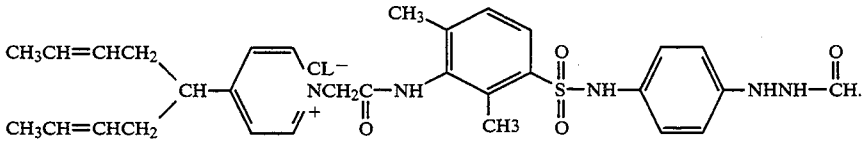

7. The element of claim 1 wherein said hydrazine nucleating agent has the structure

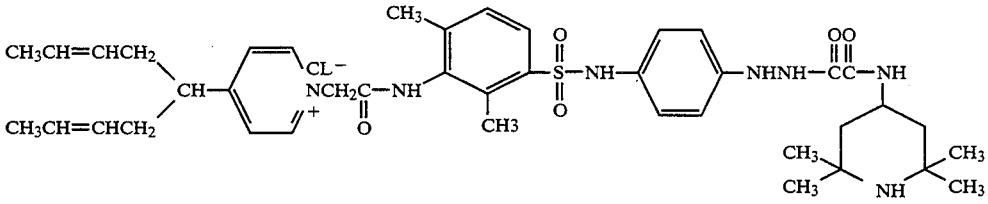

8. The element of claim 1 wherein said hydrazine nucleating agent has the structure

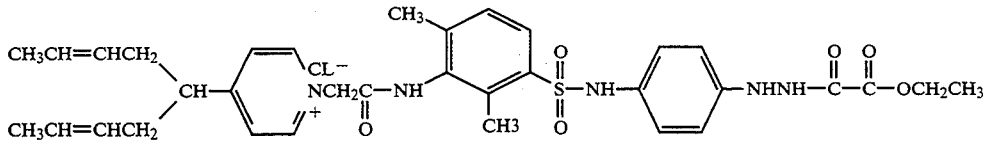

9. The element of claim 1 wherein said hydrazine nucleating agent has the structure

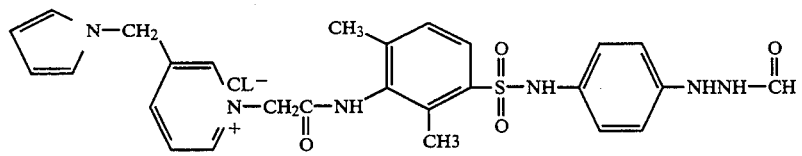

10. The element of claim 1 wherein said hydrazine nucleating agent has the structure

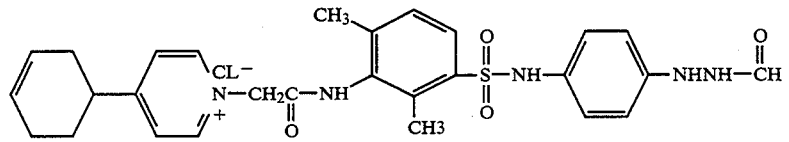

11. A process for forming a high contrast photographic image at high photographic speed with superior dot quality which comprises imagewise exposing a silver halide photographic element and developing said exposed element in a developer solution having an alkaline pH, wherein said element contains a photographic film nucleating agent having the structure

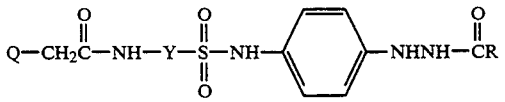

wherein R is hydrogen or $C_1$–$C_{10}$ alkyl, carbamoyl, aryloxy or alkoxy carbonyl; Y is divalent aryl, and Q is selected from the group consisting of pyridinium compounds containing unsaturated substituents, said pyridinium compounds having the structure

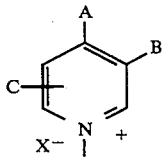

wherein A, B or C are hydrogen, alkadienyl, alkapolyenyl, cycloalkenyl or unsaturated nitrogen heterocycle radicals, with at least one of A, B or C comprising, alkadienyl, alkapolyenyl, cycloalkenyl or said unsaturated nitrogen heterocycle radicals; X is an inorganic or organic anion; wherein said element, after image-wise exposure and development, exhibits a gradient of at least 20 and excellent dot quality at a loading of said nucleating agent of $1\times10^{-3}$ moles per mole of silver.

12. The process of claim 11 wherein said pH is between 9 and 11.

13. The process of claim 11 wherein said carbamoyl has the following structure

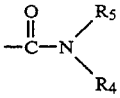

wherein $R_4$ and $R_5$, alike or different, are selected from the group consisting of hydrogen, alkyl, alkenyl, aryl, pyrrolidyl and piperidyl.

14. The process of claim 13 wherein said piperidyl comprises 2,2,6,6-tetramethyl-4-piperidyl.

15. The process of claim 11 wherein said unsaturated substituents are selected from the group consisting of divinylmethyl, diallylmethyl, 1,5-hexadien-3-yl, 2,5-heptadien-4-yl, 2,6-octadien-4-yl, 2,7-nonadien-5-yl and 3-(cyclohexen-1-yl), pyrrolyl, N-alkadiylpyrrole and pyridyl.

16. A silver halide lithographic film element having high contrast and good dot quality developable in rapid access developers without requiring boosters or alkanol amines, said element having coated thereon a silver halide emulsion and containing at least one layer incorporating a hydrazine nucleating agent having the following structure, wherein said element, after image-wise exposure and development, exhibits a gradient of at least 20 and excellent dot quality at a loading of said nucleating agent of $1\times10^{-3}$ moles per mole of silver:

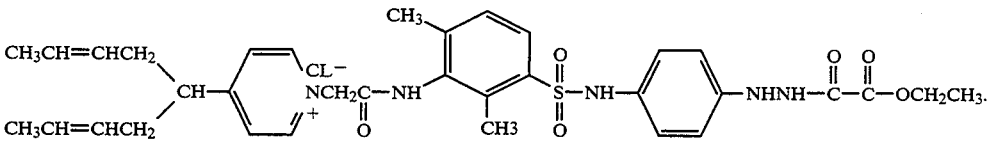
17. A silver halide lithographic film element having high contrast and good dot quality developable in rapid access developers without requiring boosters or alkanol amines, said element having coated thereon a silver halide emulsion and containing at least one layer incorporating a hydrazine nucleating agent having the structure
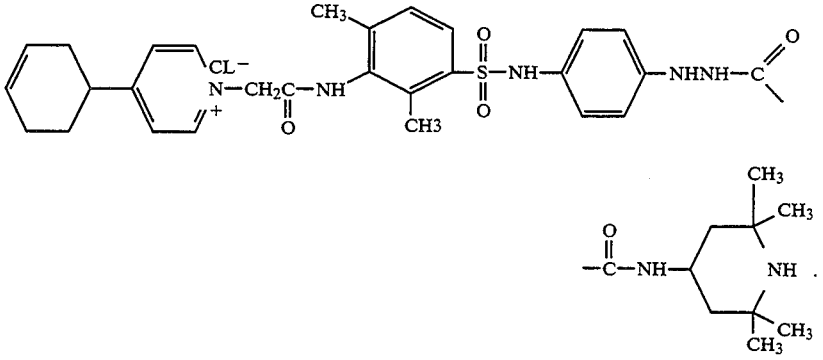
* * * * *